US005555999A

United States Patent [19]

Wilcox

[11] Patent Number: 5,555,999

[45] Date of Patent: Sep. 17, 1996

[54] SECONDARY CONTAINMENT FOR ABOVEGROUND FLAMMABLE AND COMBUSTIBLE LIQUID STORAGE TANKS

[76] Inventor: Stephen H. Wilcox, 2 Eastern Avenue, Haliburton Ontario, Canada, K0M 1S0

[21] Appl. No.: 496,090

[22] Filed: Jun. 28, 1995

[51] Int. Cl.[6] ..... B65D 25/18

[52] U.S. Cl. ..... 220/565; 220/4.12; 220/408; 220/469; 220/571

[58] Field of Search ..... 220/565, 571, 220/4.12, 408, 469

[56] References Cited

U.S. PATENT DOCUMENTS

| | | | |
|---|---|---|---|
| 4,065,022 | 12/1977 | Cainaud | 220/565 X |
| 5,033,637 | 7/1991 | Webb | 220/565 |
| 5,071,166 | 12/1991 | Marino | 220/571 X |
| 5,197,627 | 3/1993 | Disabato et al. | 220/571 X |
| 5,273,180 | 12/1993 | Whatley, Jr. . | |
| 5,287,986 | 2/1994 | Frost . | |
| 5,333,752 | 8/1994 | Harding, Jr. | 220/565 |
| 5,346,093 | 9/1994 | De Benedittis et al. . | |

FOREIGN PATENT DOCUMENTS 2070939 12/1993 Canada .

2041556 3/1994 Canada .

*Primary Examiner*—Steven M. Pollard

*Attorney, Agent, or Firm*—Dickinson, Wright, Moon, Van Dusen & Freeman

[57] ABSTRACT

An above-ground secondary containment unit for storage tanks is comprised of a rigid base and upwardly extending side and end walls. Side cover shields are mounted to the top of the side walls by way of hinges and are intended to contact a side surface of the storage tank thus minimizing or preventing the entry of precipitation or debris into the unit while the tank is in place. End cover shields are mounted to the top of the end walls using a nut and bolt arrangement and slots in the shield allowing for lateral adjustment of the shields with respect to an end surface of tanks of varying sizes and configurations. These shields similarly minimize or prevent the entry of precipitation and debris into the unit. The walls of the unit are tapered so that one unit may be nested within another similarly shaped unit for convenient storage and to permit shipment of multiple units at the same time. Linear tie-down straps are mounted to one side wall and extend across the top of the unit to the other side wall in order to secure a tank in place. The whole unit may be mounted on skids to allow transport either alone, or in combination with a tank secured by the tie-down straps.

13 Claims, 2 Drawing Sheets

SECONDARY CONTAINMENT FOR ABOVEGROUND FLAMMABLE AND COMBUSTIBLE LIQUID STORAGE TANKS

BACKGROUND OF THE INVENTION

The present invention relates to a secondary containment unit for closed storage tanks which hold hazardous and non-hazardous liquids, such as petroleum and the like. More particularly, the invention provides an above-ground, transportable containment unit, or dike, which can fit new or existing storage tanks of varying sizes.

National safety and fire standards require that when an above-ground liquid storage tank is used on site, it must be contained within a containment unit in order to contain any spills or leaks which might contaminate the environment or otherwise pose a hazard. These containment units, commonly referred to as "dikes", are generally open-topped tubs and must be a prescribed size so as to accommodate the volume of liquid held by the tank. The open top is prescribed by safety standards which prohibit the use of a cover with the dike. However, an open top permits the entry of precipitation and debris into the dike thus allowing contact with any liquid which may accumulate in the dike. This contamination would prevent any future re-use of the liquid and could pose disposal problems requiring the use of a specialized waste disposal system.

Many of the dikes currently in use do not provide a means for protecting against the collection of precipitation and debris in the dike. For those that do, the protection device typically interferes with the venting, piping or pumping equipment located on the top of the tank.

Further, in order to meet the existing safety standards, many of the existing dikes require 1.5 meters spacing between the dike wall and any surface of the tank while in use. The storage and transportation constraints which result from this oversizing are obvious and often prevent a dike from being transported beyond a minimal distance from site to site. The configuration of these dikes also prevents the units from being easily transported over anything other than a small distance, thus giving the industry a regional nature.

For those secondary units which do provide some means of portability, there is no provision for transporting the dike with the tank in place. While many of the existing units, as disclosed in combination with a tank, may be transported over a short distance those that are secondary units for existing tanks cannot be transported with the tank in place because the dike does not provide means for securing the tank during transport. Therefore, in the event that a storage tank is needed at a different work site, it must be removed from the dike and each piece must be transported separately. This not only represents increased labor and time, it may also result in increased costs to the user of the dike.

U.S. Pat. No. 5,273,180 of Whatley Jr., issued Dec. 28, 1993 relates to a rectangular, open topped containment tank in combination with a liquid storage tank. The containment tank is mounted on skids to facilitate movement across the ground, with a towing bar at least one end of the skids. There is also provided within the containment tank a means for supporting the storage tank in position during usage.

Canadian Patent Application Ser. No. 2,070,939 of Burton published Dec. 11, 1993 relates to a cylindrical inner tank in combination with a rectangular, open topped outer tank. The outer tank is provided with cover means permanently affixed to the walls of the outer tank and extending to the outer surface of the inner tank.

Canadian Patent No. 2,041,556 of Harp issued Mar. 1, 1994, relates to a hooded rectangular containment dike with access means provided in the hood aligned to the expected input or output lines on an inner storage tank.

U.S. Pat. No. 5,287,986 of Frost issued Feb. 22, 1994 describes a cylindrical outer containment unit provided with a cover or hood.

It is an object of the present invention to provide an above-ground secondary containment unit for existing storage tanks of varying sizes and designs which minimizes or prevents the entry of precipitation and debris within the unit while the storage tank is in place yet permits easy access to all pumping, piping and venting on the storage tank. It is a further object of the invention to provide a means for convenient storage of the unit which permits shipment over greater distances than is currently feasible with existing units. Yet a further object is to provide means for securing the storage tank within the unit so as to meet safety standards and eliminate the need to remove the tank prior to transporting the unit.

SUMMARY OF THE INVENTION

In one aspect of the invention there is provided an above-ground secondary containment unit for holding closed liquid storage tanks. The unit is made up of a rigid base, side walls extending upward from the base on either side and end walls extending upward from the base connecting the side walls. The unit has an open top. There is provided a plurality of linear straps affixed at spaced locations to a side wall extending across the top to the opposite side wall, for releasably securing the storage tank within the unit during usage and during transport thereof. There is further provided side cover means secured to the side walls by hinges and extending from the side walls to a side outer surface of the storage tank during usage to minimize or prevent the entry of precipitation and other materials between the tank and the side walls of the unit. There is also provided end cover means affixed to and extending from the end walls and resting on an end outer surface of the storage tank while in use to similarly minimize or prevent the entry of precipitation and the like into the unit.

In a preferred embodiment of the invention, the unit is mounted on a horizontal planar skid member to provide a means for transporting the unit either with or without the storage tank in place within the unit.

In another preferred embodiment of the invention, slotted apertures are provided on the end cover means for releasably securing the cover means to the end walls while allowing for lateral adjustment of the cover means. This lateral adjustment permits the cover means to be in abutting relation to portions of an end surface of storage tanks of varying sizes.

The side walls and end walls preferably extend upwardly from the rigid base at relative outwardly projecting angles. This permits the unit to be stacked within another unit for storage and shipment.

In another aspect of the invention, the unit is combined with a closed storage tank suitable for the safe storage of liquids. The tank is releasably secured within the unit by the straps.

The dike of the present invention thus provides an above ground, transportable containment unit made to accommodate storage tanks of varying sizes. The dike's open top and movable side shields and end shields facilitate easy insertion of the tank within the dike and unimpeded access to any vents, piping or pumps located on the top of the tank. While in place, the shields minimize or prevent entry of precipitation and debris between the dike and the tank. The dike is provided with tie-down straps to secure a tank in place during usage and also providing a means for securely transporting the tank and the dike as a single unit.

BRIEF DESCRIPTION OF THE DRAWINGS

These and other advantages of the invention will become apparent upon reading the following detailed description and upon referring to the drawings in which.

Figure 1:
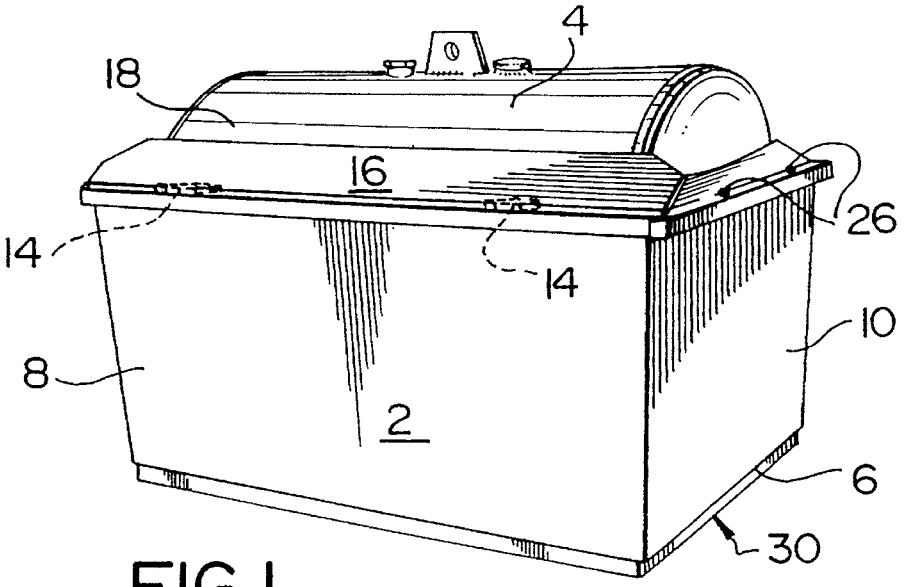
FIG. 1 is a perspective view of the secondary containment unit in combination with a closed storage tank according to the present invention.
Figure 2:
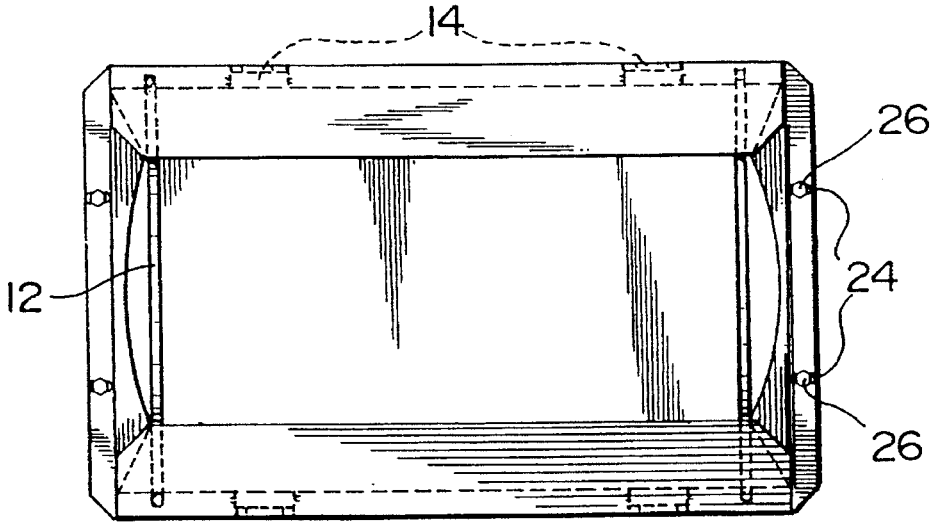
FIG. 2 is a top plan view of the secondary containment unit alone.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 3:
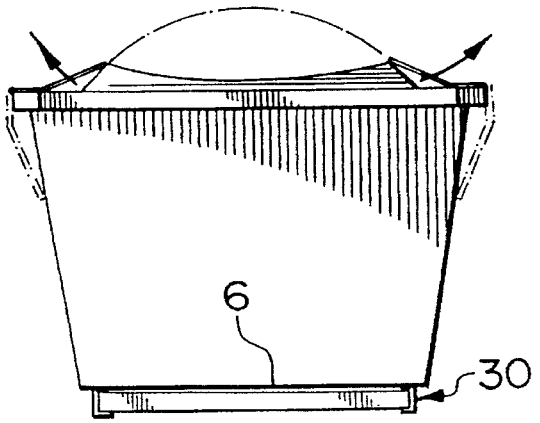
FIG. 3 is an end view of the secondary containment unit of FIGS. 1 and 2.

Turning to the drawings, FIG. 1 shows an above-ground secondary containment unit 2 in accordance with the present invention for an existing liquid storage tank 4. The unit 2 comprises a rigid base 6, two opposite facing side walls 8 extending upwardly and outwardly from the base 6 and two end walls 10 connected to the side walls 8 at either end thereof. This tapered shape, as shown in FIGS. 1 and 3, facilitates shipment by permitting one unit 2 to be nested within another similarly shaped unit (not shown). Two tie-down straps 12 are provided with means 13 for affixing the straps to the side walls at a position shown in FIG. 1.

Figure 4:
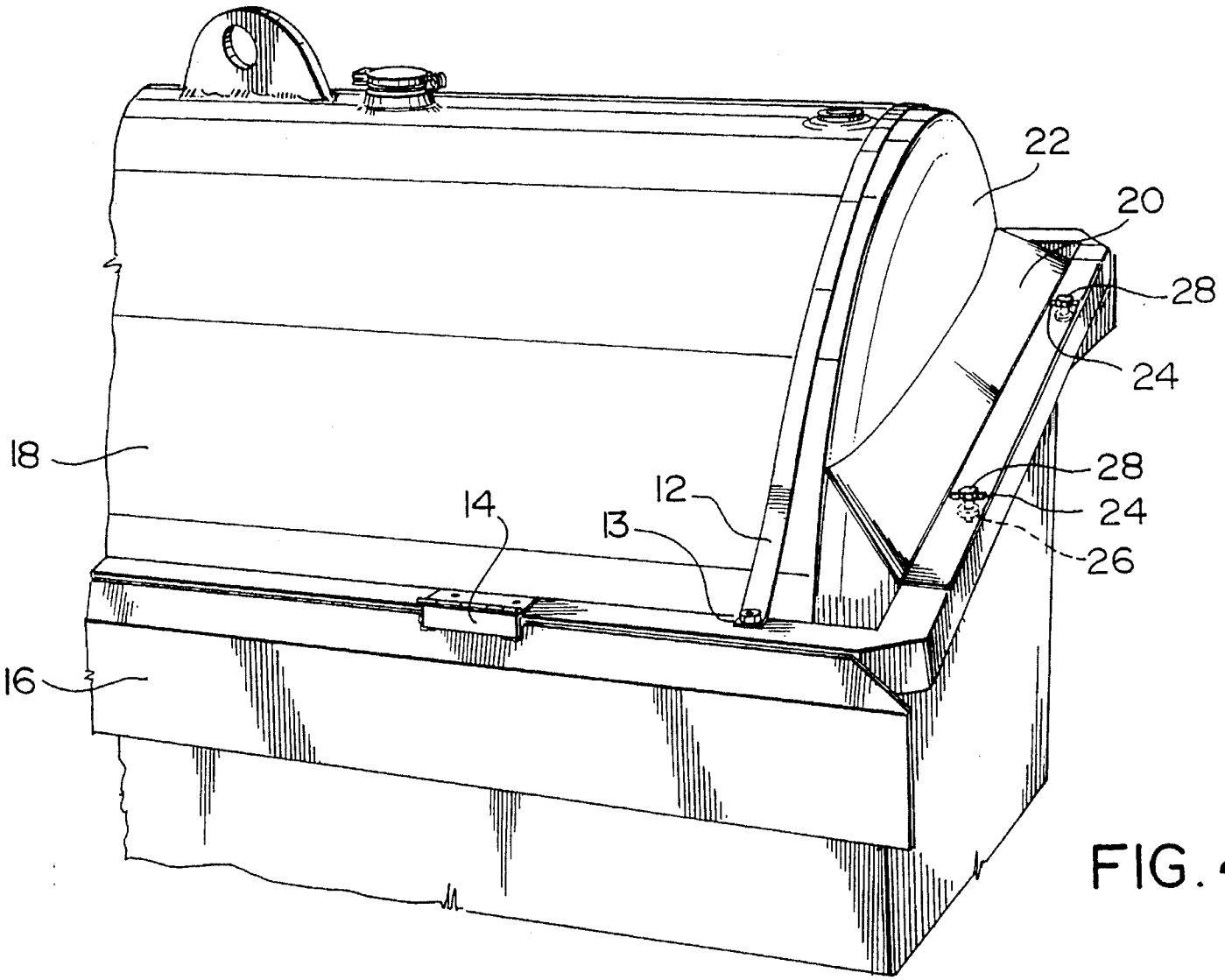
FIG. 4 is a perspective partial view of an end of the unit in FIG. 1 showing in more detail a strap, a side cover means in open position, a side cover hinge and end cover.

There is mounted on each of the side walls 8, by way of a plurality of hinges 14, a side cover means 16, which rests on a side surface 18 of the tank 4 while in use. These cover means 16 minimize or prevent the entry of precipitation, debris and the like between the unit 2 and the tank 4. The side cover means 16 pivots about the hinges 14 to allow easy access to the tank 4 or the interior of the unit 2. The side cover means 16 in open position is shown in FIG. 4.

At the top of each of the end walls 10 is an end cover means 20, adjustably mounted by way of a slotted aperture 24 in combination with a nut 26 and bolt 28 arrangement. The slotted aperture 24 allows for lateral adjustment of the end cover means 20 relative to the length of the tank 4. When in position, the end cover means 20 rests against an end surface 22 of the tank 4, thus further preventing the entry of precipitation, debris and the like between the unit 2 and the tank 4.

In a preferred embodiment of the invention as illustrated, the unit 2 is mounted on a transport means in the form of, for example, a horizontal planar skid member 30 as shown in FIGS. 1 and 3 under the rigid base 6 for support during usage and transport of the unit 2.

Thus, it is apparent that there has been provided in accordance with the invention an above-ground secondary containment unit that fully satisfies the objects, aims and advantages set forth above. While the invention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows: What I/we claim as My/our invention:

1. An above-ground secondary containment unit for closed storage tanks comprising a rigid base, upwardly extending side walls, upwardly extending end walls transversely connecting the side walls and open top, linear strap means affixed to the side wall and extending across the top to the opposite side wall for releasably securing the tank within the unit during usage and during transport thereof, side cover means hingedly secured to and extending from the side walls, to rest on a side outer surface of the storage tank during usage for minimizing or preventing entry of precipitation and other materials into the containment unit, end cover means affixed to and extending from the end walls, resting on the end outside surface of the storage tank during usage for further minimizing or preventing entry of precipitation and the like into the unit.

2. A unit as provided for in claim 1 wherein the end cover means are provided with means permitting lateral adjustment of said cover means so that said cover means are in abutting relation to portions of an end surface of the tank.

3. A unit as provided for in claim 2 wherein the cover means are provided with slotted apertures for releasably mounting to the end walls and are secured to the end walls by nut and bolt means.

4. A unit as provided for in claim 1 wherein the linear strap means comprises a plurality of straps at spaced locations of the unit.

5. A transportable unit as provided for in claim 1 wherein the base is further provided with transport means.

6. A transportable unit as provided for in claim 5 wherein the transport means comprise skid means secured to the base for support thereof during usage and during transportation.

7. A unit as provided for in claim 1 wherein the side walls and the end walls extend upwardly from the base at relative outwardly projected angles to provide for convenient storage of the unit within another said unit.

8. An above-ground secondary containment unit in combination with a closed tank suitable for the safe storage of liquids, the unit comprising a rigid base, upwardly extending side walls, upwardly extending end walls transversely connecting the side walls and open top, the tank seated within and secured therein against relative movement by a linear strap means affixed to the side wall and extending across the top of the tank to the opposite side wall, side cover means hingedly secured to and extending from the side walls, resting on side outer surfaces of the storage tank for minimizing or preventing entry of precipitation and other materials between the tank and the containment unit when in use, end cover means affixed to and extending from the end walls, resting on the end outside surface of the storage tank for further minimizing or preventing entry of precipitation and the like therebetween while in use.

9. A unit as provided for in claim 8 wherein the end cover means are provided with means permitting lateral adjustment of said cover means so that said cover means are in abutting relation to portions of an end surface of the tank.

10. A unit as provided for in claim 9 wherein the cover means are provided with slotted apertures for releasably mounting to the end walls and are secured to the end walls by nut and bolt means.

11. A unit as provided for in claim 8 wherein the linear strap means comprise a plurality of straps at spaced locations of the unit.

12. A transportable unit as provided for in claim 8 wherein the base is further provided with transport means.

13. A transportable unit as provided for in claim 12 wherein the transport means comprise a skid means secured to the base for support thereof during usage and during transportation.

* * * * *